US006682319B2

(12) United States Patent
Kobayashi

(10) Patent No.: US 6,682,319 B2
(45) Date of Patent: Jan. 27, 2004

(54) MOTOR FAN UNIT ATTACHMENT STRUCTURE AND RADIATOR ASSEMBLY FITTED WITH A MOTOR FAN UNIT

(75) Inventor: Toshimi Kobayashi, Fujisawa (JP)

(73) Assignee: Nissan Motor Co., Ltd., Kanagawa (JP)

( * ) Notice: Subject to any disclaimer, the term of this patent is extended or adjusted under 35 U.S.C. 154(b) by 55 days.

(21) Appl. No.: 10/035,431

(22) Filed: Jan. 4, 2002

(65) Prior Publication Data

US 2002/0090297 A1 Jul. 11, 2002

(30) Foreign Application Priority Data

Jan. 9, 2001 (JP) ..... 2001-001817

(51) Int. Cl.[7] ..... F04B 17/00; F04B 35/00

(52) U.S. Cl. ..... 417/360; 417/423.15; 123/41.49; 165/121; 165/122

(58) Field of Search ..... 417/360, 423.15; 123/41.49; 165/121, 122

(56) References Cited

U.S. PATENT DOCUMENTS 4,329,946 A * 5/1982 Longhouse ..... 123/41.49
4,685,513 A * 8/1987 Longhouse et al. ..... 165/121
4,836,148 A * 6/1989 Savage et al. ..... 123/41.49
5,341,871 A * 8/1994 Stelzer ..... 165/121
5,474,121 A * 12/1995 Bryson et al. ..... 165/41
5,522,457 A * 6/1996 Lenz ..... 165/121
5,671,803 A * 9/1997 Tepas et al. ..... 165/41
6,000,460 A * 12/1999 Yamanaka et al. ..... 165/67

FOREIGN PATENT DOCUMENTS

| | | |
|---|---|---|
| DE | 42 44 037 A1 | 6/1994 |
| FR | 2 713 754 A1 | 6/1995 |
| FR | 2 785 379 A1 | 5/2000 |
| JP | 7-61246 | 3/1995 |

* cited by examiner

*Primary Examiner*—Justine R. Yu
*Assistant Examiner*—William H. Rodriguez
(74) *Attorney, Agent, or Firm*—McDermott, Will & Emery

(57) ABSTRACT

By inserting an insertion section provided on a lower end of a motor fan unit into a wedge shaped hole provided in a lower part of a radiator, a motor fan unit is attached to a side of the radiator to the vehicle rear. A vehicle front perpendicular surface and a vehicle rear perpendicular surface are formed on the insertion section. The vehicle front perpendicular surface contacts a perpendicular surface of the wedge shaped hole, while the vehicle rear perpendicular surface contacts a lower end of an inclined surface of the wedge shaped hole. These surfaces will be in contact with one another even if the radiator stretches in the vertical direction due to evacuation and irrigation so that the insertion section slides upwards. As a result, it is possible to prevent rattling of the motor fan unit.

8 Claims, 12 Drawing Sheets

MOTOR FAN UNIT ATTACHMENT STRUCTURE AND RADIATOR ASSEMBLY FITTED WITH A MOTOR FAN UNIT

BACKGROUND OF THE INVENTION

1. Field of the Invention

The present invention relates to a motor fan unit attachment structure for attaching a motor fan unit to a radiator, and to a radiator assembly fitted with a motor fan unit.

2. Related Art

An attachment structure for attaching a motor fan unit to a vehicle-mounted radiator is known from the disclosure of Japanese Laid-Open Patent Publication No. H 7-61246. In this attachment structure a plug is provided on a lower section of a motor fan unit for connecting to a radiator. This plug is inserted into an attachment section at the bottom of the radiator. The upperpart of the motor fan unit is connected to an upper part of the radiator using bolts. The plug may have a wedge shape with a wide edge at the upper end, and also may be a pin structure for inserting a pin of fixed thickness into a hole.

SUMMARY OF THE INVENTION

After attaching a motor fan unit to a radiator, the radiator is filled with water after vacuuming at an assembly plant. When the inside of the radiator is vacuumed out, the radiator is shortened in the vertical direction of the mounted state. For this reason a radiator plug of the motor fan unit is formed so as to have clearance in the vertical direction. With this type of structure, above described clearance is filled when the inside of the radiator is vacuumed out. After that, since the radiator returns to its vertical dimensions if irrigation of the radiator is carried out, the above-described clearance is generated. If the plug is wedge shaped, a plug of the motor fan rises up with respect to an attachment section of a wedge shaped hole in the radiator. This section therefore rattles with vibration of the vehicle, causing strange noises. The rattling also abrades the plug, and there is a problem that fixing sections on the upper part of the radiator are prone to being subjected to unnatural loads.

On the other hand, in the case of a perpendicular plug structure, such as the pin structure, there is no rattling in the horizontal direction, namely in the front to rear direction of the vehicle, unlike the wedge shaped plug. However, in order to ensure operability at the time of assembly, it is necessary to reduce the size of the fan shroud in the vertical direction (the vertical direction of the vehicle) by the extent of an insertion stroke for insertion perpendicular to the plug. As a result, the surface area of the radiator core that is covered by the fan shroud becomes small, and there is a problem that the cooling efficiency of the radiator is deteriorated.

The object of the present invention is to provide a motor fan unit attachment structure and radiator assembly having a motor fan unit that can prevent rattling of the motor fan unit without having a detrimental effect on the ease of assembly or cooling efficiency.

A motor fan unit attachment structure according to the present invention comprises upper attachment sections provided on respective upper parts of a radiator and a motor fan unit which is attached to the radiator at a downstream side of air flow through the radiator, and fastened together using fastening members, and lower attachment sections that include an inserted section provided on a lower part of the radiator and an insertion section provided on a lower part of the motor fan unit for inserting into the inserted section, furthermore, upstream side contact sections for bringing the inserted section and the insertion section into contact with each other, are provided respectively at upstream sides of air flows of the inserted section and the insertion section, and downstream side contact sections for bringing the inserted section and the insertion section into contact with each other, are provided respectively at downstream sides of air flows of the inserted section and the insertion section, so as to regulate movement of the insertion section and the inserted section to the down stream side and the upstream side of the air flow through the radiator, and so as to enable movement of the insertion section and the inserted section in a vertical direction.

A motor fan unit attachment structure according to the prevent invention comprises upper attachment sections provided on respective upper parts of a radiator and a motor fan unit attached to the radiator at a downstream side of air flow through the radiator, and fastened together using fastening members, and lower attachment sections that include an inserted section provided on a lower part of the radiator and an insertion section provided on a lower part of the motor fan unit for inserting into the inserted section, furthermore, the inserted section is a wedge shaped hole or indentation that narrows towards a lower end of the inserted section and is provided with an inclined surface formed at a downstream side of air flow through the radiator and a perpendicular surface formed at a position opposite to the inclined surface, and the insertion section is provided with a first contact section formed so as to extend in a perpendicular direction, that contacts the perpendicular surface, a second contact section that contacts a lower end of the inclined surface and extends by a specified length in the perpendicular direction beyond said lower end of the inclined surface and a third contact section formed opposite to the first contact section, capable of contacting the inclined surface of the inserted section.

A motor fan unit attachment structure according to the present invention comprises upper attachment sections provided on respective upper parts of a radiator and a motor fan unit attached to the radiator at a downstream side of air flow through the radiator and fastened together using fastening members, and lower attachment sections that includes an inserted section provided on a lower part of the radiator and insertion section provided on a lower part of the motor fan unit for inserting into the inserted section, furthermore, the inserted section is a wedge shaped hole or indentation that narrows towards a lower end of the inserted section and is provided with an inclined surface formed at a downstream side of air flow through the radiator and a perpendicular surface formed at a position opposite to the inclined surface, and the insertion section is provided with a first contact section formed so as to extend in a perpendicular direction, that contacts the perpendicular surface, a second contact section that contacts a lower end of the inclined surface and extends by a specified length in the perpendicular direction beyond the lower end of the inclined surface, a third contact section formed opposite to the first contact section and enabling contact with the inclined surface, and a sliding surface formed between a lower end of the first contact section and a lower end of the second contact section so that the insertion section moves along the perpendicular surface of the inserted section when the insertion section is inserted into the inserted section.

In a radiator assembly fitted with a motor fan unit according to the present invention, the radiator and the motor fan unit are integrated using a motor fan unit attachment structure of any one of claim 1 to claim 8.

DETAILED DESCRIPTION OF THE PREFERRED EMBODIMENTS

Embodiments of the present invention will now be described in the following with reference to FIGS. 1 through 12.

Figure 1:
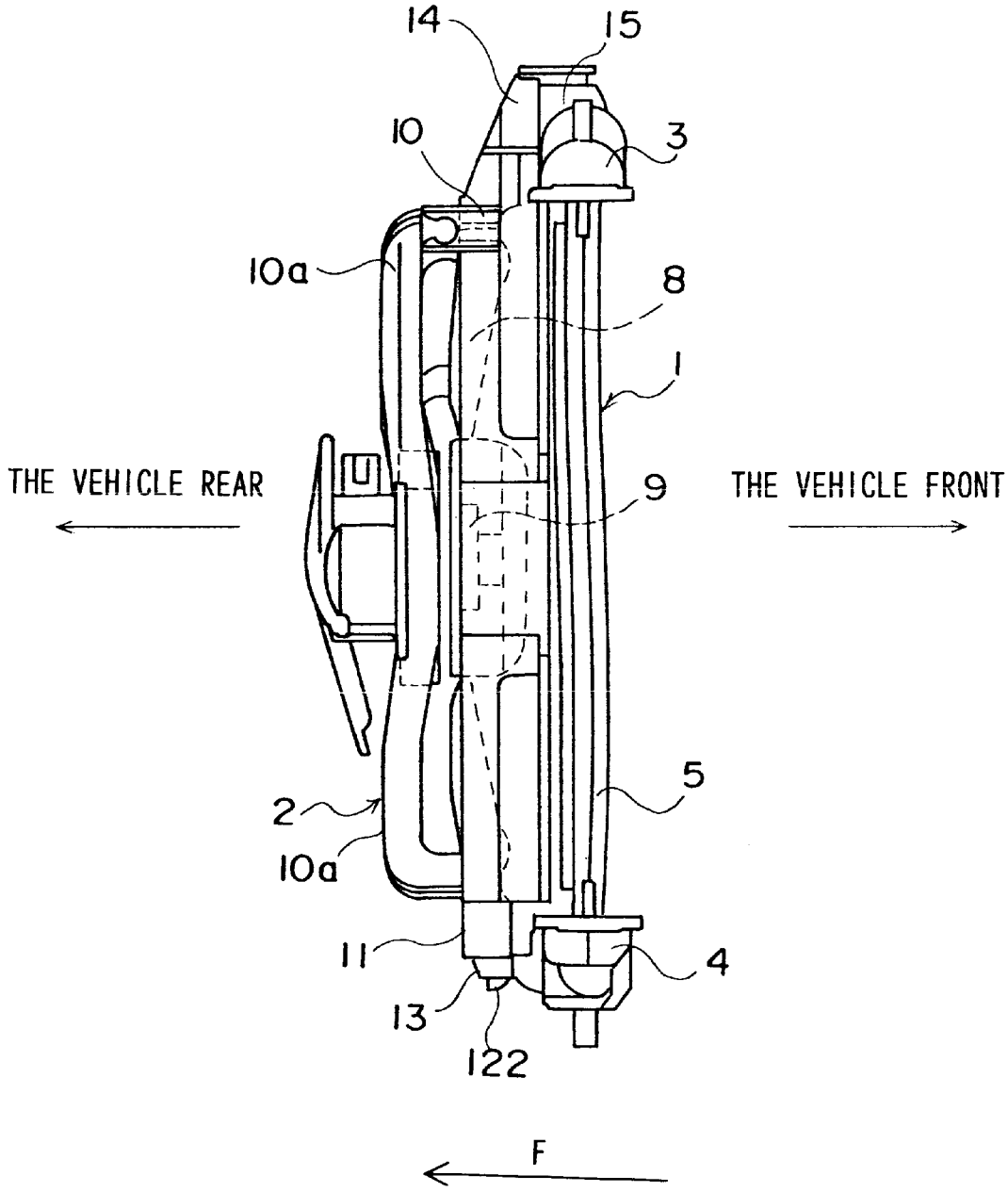
FIG. 1 is a side elevation showing a motor fan unit attached to a vehicle-mounted radiator, according to one embodiment of the present invention.
Figure 2:
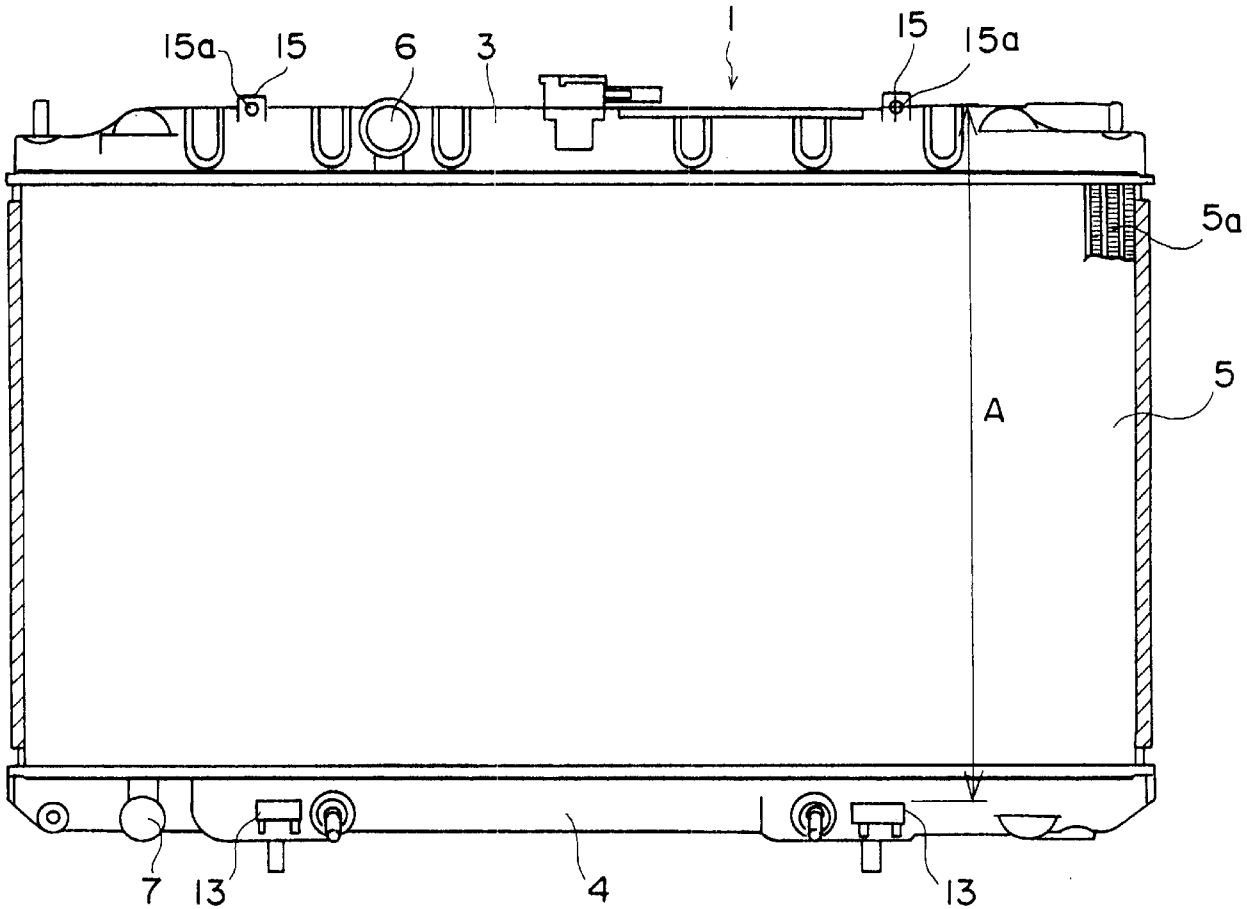
FIG. 2 is a drawing of the radiator viewed from the rear of a vehicle.
Figure 3:
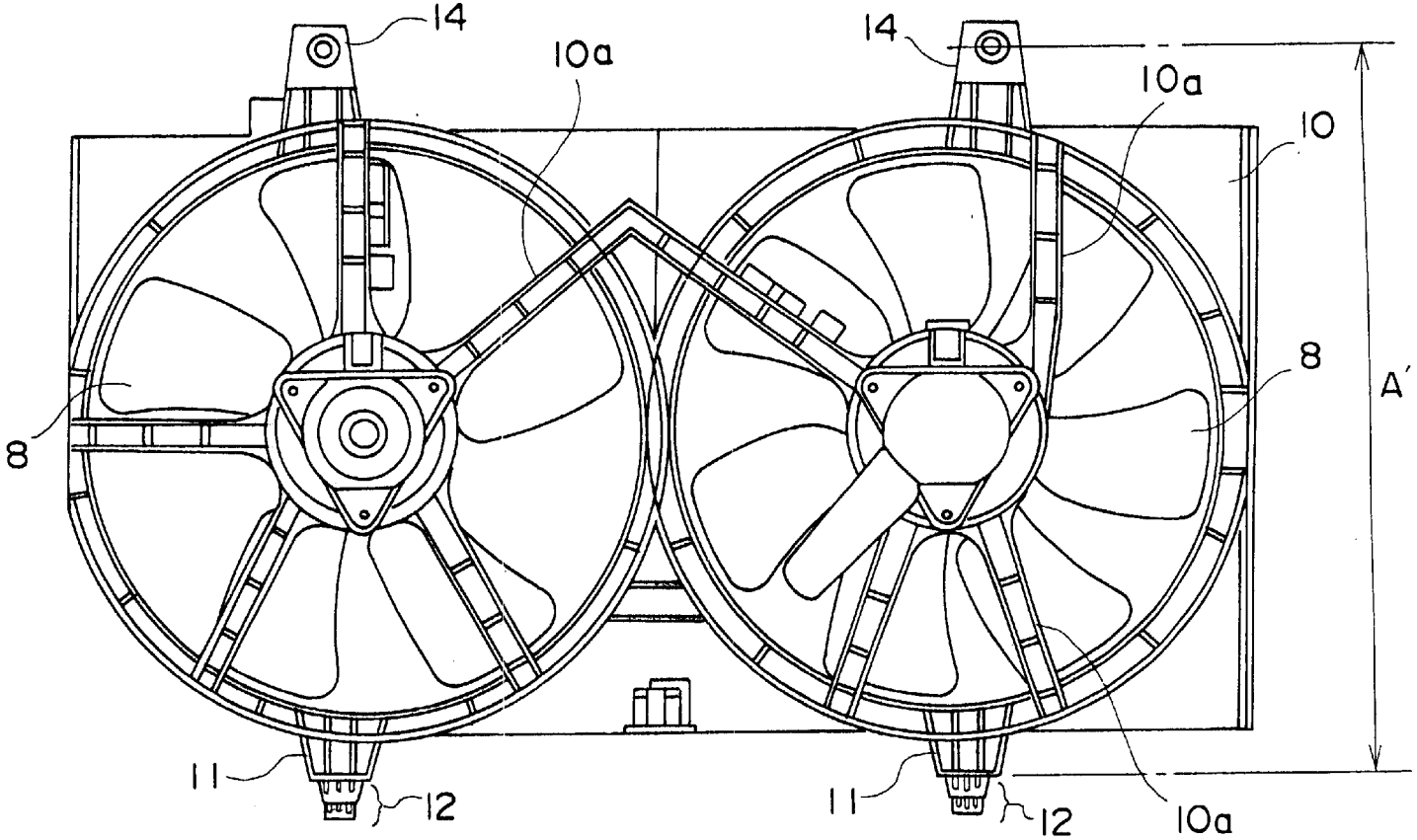
FIG. 3 is a drawing of the motor fan unit viewed from the rear of the vehicle.

FIGS. 1–3 are drawings describing one embodiment of the present invention. FIG. 1 is a side elevation showing the appearance of a motor fan unit 2 attached to a vehicle-mounted radiator 1, according to one embodiment of the present invention. The motor fan unit 2 is attached to a side of a radiator 1 to the rear of the vehicle. Air flows across the radiator 1 from the front side of the vehicle to the rear side of the vehicle, as shown by the arrow F in FIG. 1. That is, the front side of the vehicle is upstream of the airflow, and the rear side of the vehicle is downstream of the air flow. FIG. 2 is a drawing showing the radiator 1 viewed from the rear of the vehicle, and FIG. 3 is a drawing of the motor fan unit 2 viewed from the rear of the vehicle.

As shown in FIG. 2, the radiator 1 comprises an upper tank 3, a lower tank 4 and a core 5. Cooling fins 5*a* are formed in the core 5. In order to ensure ease of viewing, the cooling fins 5*a* are only shown on part of the core 5. Cooling water flows from an inlet 6 to the upper tank 3, then carries out cooling while flowing downwards inside the core 5, and eventually reaches the lower tank 4. The cooling water cooled in the radiator 1 is supplied to a cooling block of the engine via an outlet 7 provided in the lower tank 4 and a cooling hose, not shown in the drawings. Two bolt fastening sections 15 having threaded holes 15*a* are provided in an upper end of the upper tank 3. Two brackets 13 having wedge shaped holes are provided on the surface of the lower tank 4 toward the rear of the vehicle.

As shown in FIG. 1, the motor fan unit 2 is provided with a cooling fan 8 and a motor 9 for rotatively driving the cooling fan 8, and the motor 9 is fixed to a support section 10*a* formed in the fan shroud 10. As shown in FIG. 3, a pair of legs 11 is provided on a lower end of the fan shroud 10, and an insertion section (a plug) 12 is formed in a lower part of each leg 11. Two fixing sections 14 positioned in correspondence with the bolt fastening sections 15 of the radiator 1 are formed in an upper part of the fan shroud 10. Each plug 12 is respectively inserted into wedge shaped holes in the bracket 13 of the lower tank 4, and the fixing sections 14 are bolt fastened to the bolt fastening sections 15 of the upper tank 3. In this way, the motor fan unit 2 is attached to the side of the radiator 1 towards the rear of the vehicle.

The insertion sections 12 and the brackets 13 joining the motor fan unit 2 and the radiator 1 will now be described in detail.

Figure 4:
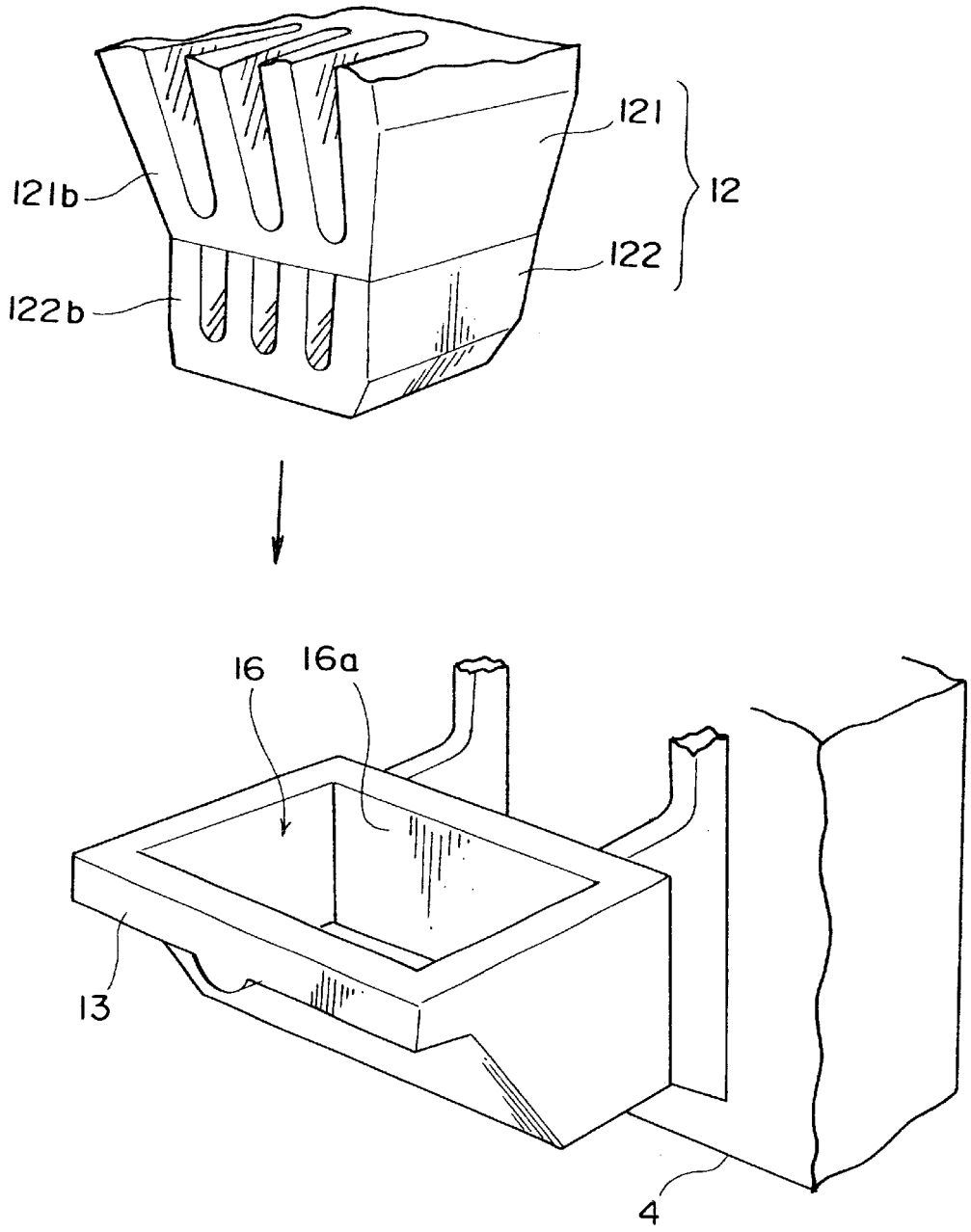
FIG. 4 is a perspective view showing an enlargement of a plug and a bracket.
Figure 5A:
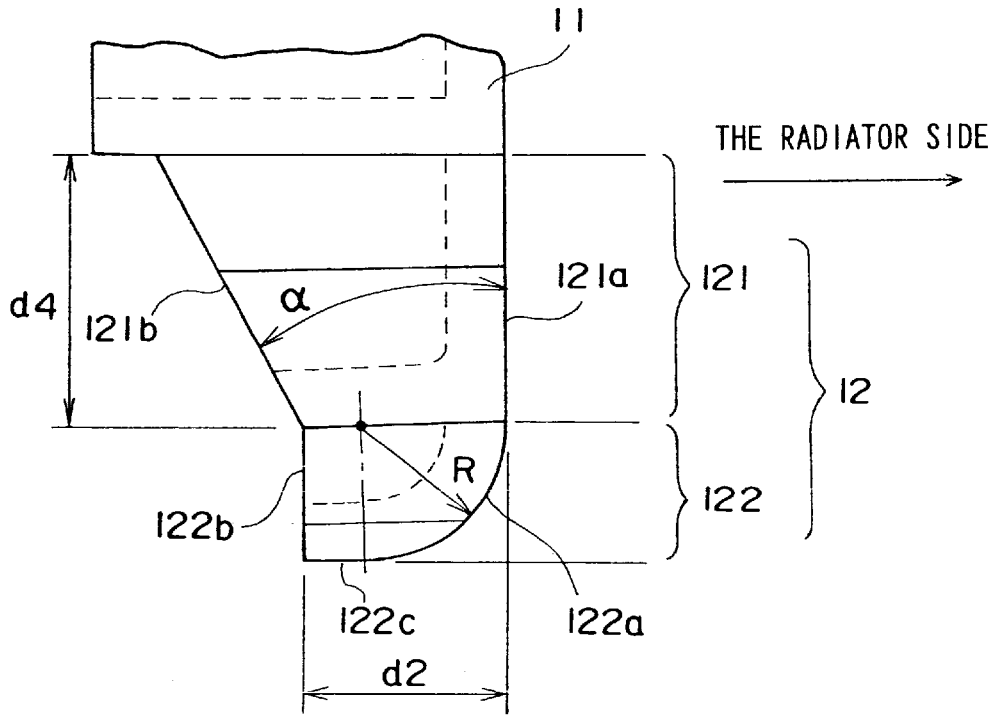
FIG. 5A is a side elevation of a plug.

FIG. 4 is a perspective view showing an enlargement of the insertion sections 12, being lower attachment sections of the motor fan unit 2, and the brackets 13, being lower attachment sections of the radiator 1. FIG. 5A is a side elevation of the insertion section 12, while FIG. 5B is a cross section of the bracket 13.

Figure 5B:
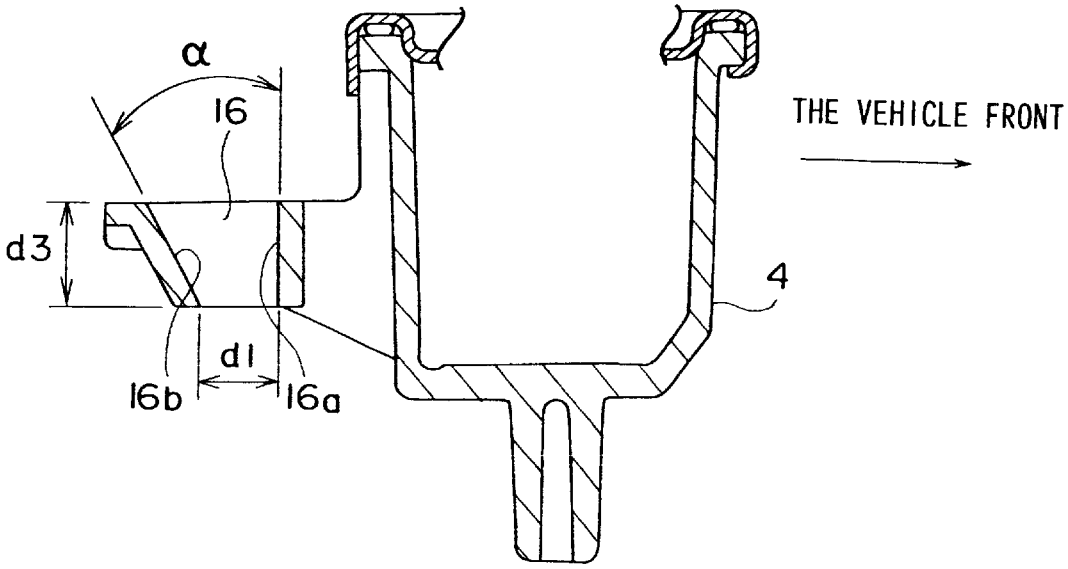
FIG. 5B is a cross section of the bracket.

As shown in FIG. 5B, a wedge shaped hole (an inserted section) 16 narrowing towards the bottom in FIG. 5B is formed in the bracket 13 provided on the lower tank 4. The wedge shaped hole 16 has a substantially perpendicular surface 16*a* at a side toward the vehicle front, and an inclined surface 16*b* opposite to the perpendicular surface 16*a*. The perpendicular surface extends in the vertical direction of FIG. 5B when the radiator 1 is mounted in the vehicle. The angle between the perpendicular surface 16*a* and the inclined surface 16*b* is called $\alpha$.

The insertion sections 12 of the motor fan unit 2 are formed from a wedged shaped section 121, and a tip section 122 having an R surface 122*a*, as shown in FIG. 5A. A surface 121*a* extending in the vertical direction of FIG. 5A, namely in a perpendicular direction, is formed on a radiator side of the wedge shaped section 121, namely on the side toward the vehicle front, and on the opposite side, namely on the side to the vehicle rear, an inclined surface 121*b* is formed. The angle between the surface 121*a* and the surface 121*b* is substantially the same as the angle $\alpha$ between the surface 16*a* and the surface 16*b* of the wedge shaped hole 16. A radiator side of the tip section 122, namely a side towards the front of the vehicle, forms an R surface 122*a* curving more towards the rear of the vehicle closer to the tip. That is, the R surface 122*a* is formed so as to curve to the lower side of the insertion section 12. A flat surface 122*c* is formed continuous with the R surface 122*a*. A perpendicular surface 122*b* is also formed on a side of the tip section 122 towards the rear of the vehicle. As shown in FIG. 4, grooves are formed in the inclined surface 121*b* and the perpendicular surface 122*b*, and a cross section of the wedge shaped section 121 and the tip section 122 forms a comb tooth-shaped surface.

With one embodiment of the present invention, as shown in FIG. 5A and FIG. 5B, the insertion sections 12 have dimensions d2 and d4, while the brackets 13 have dimensions d1 and d3, being set such that d1=d2, and d3=d4.

The operation of attaching the motor fan unit 2 provided with the above described insertion sections 12 to the radiator 1 having the above described brackets 13 will now be described.

Figure 6A:
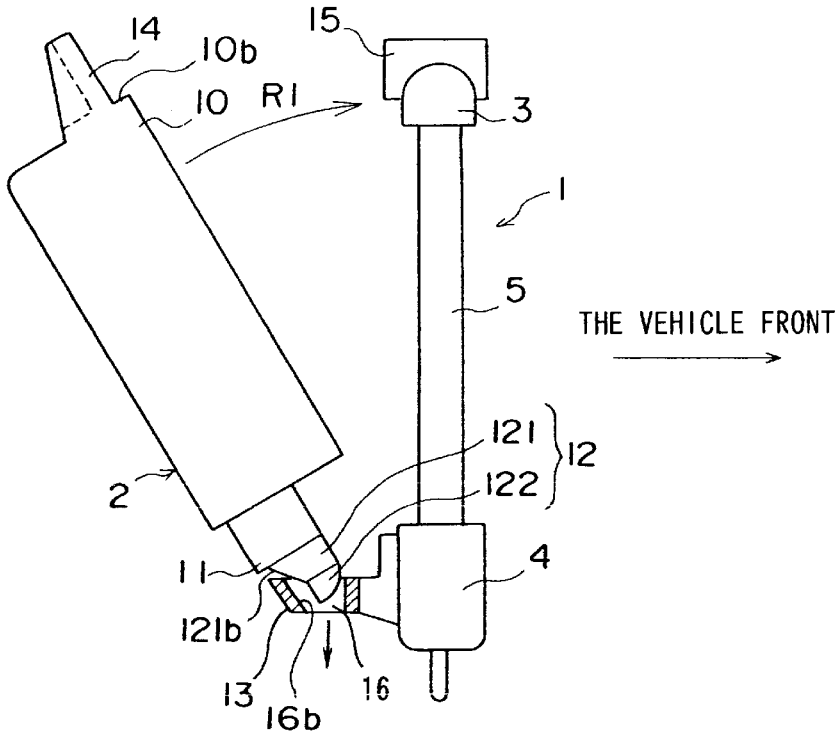
FIG. 6A is a drawing showing an outline of a motor fan unit attachment operation.
Figure 6B:
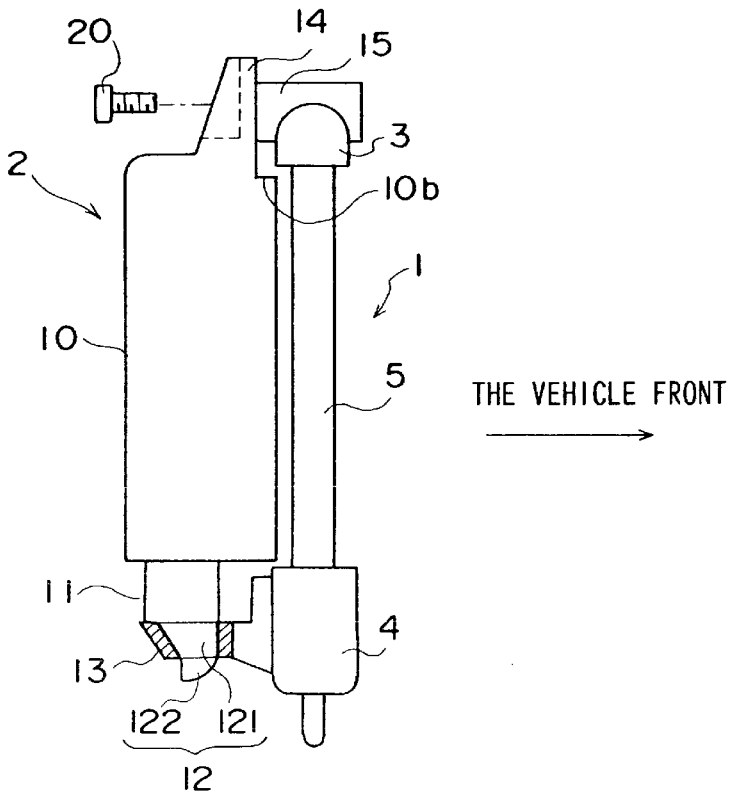
FIG. 6B is a drawing showing an outline of a motor fan unit attachment operation.

FIGS. 6A and 6B are drawings for describing the operation of attaching the motor fan unit 2 to the radiator 1. First of all, as shown in FIG. 6A, the insertion sections 12 of the motor fan unit 2 are placed on the brackets 13 so that the inclined surface 121*b* of the wedge shaped section 121 comes into contact with the upper end of the inclined surface 16*b* of the wedge shaped hole 16, that is, so that the inclined surface 121*b* comes into contact with the edge of the wedge shaped hole 16. The upper part of the motor fan unit 2 is made to rotate in the direction of the radiator 1, as shown by the arrow R1, with the contacting portions of the insertion sections 12 and the brackets 13 described above as a fulcrum, and the motor fan unit 2 is put into a vertical state as shown in FIG. 6B. At this time, the vertical direction of the motor fan unit 2 is substantially parallel to the vertical direction of the radiator 1. The fixing sections 14 of the motor fan unit 2 and the fastening sections 15 of the radiator 1 are then fastened using bolts.

The size of the radiator 1 in the vertical direction is shortened by vacuuming the radiator 1 after attachment of the motor fan unit 2 and the radiator 1. After that, the radiator 1 is filled with water and the size of the radiator 1 in the vertical direction returns to its original size. Therefore, as shown in FIGS. 2 and 3, a dimension A between the upper end surface of the bracket 13 and the center of the threaded bolt hole 15*a* of the bolt fastening section 15 is set to a value resulting from adding a dimension c, of the radiator shortened in the vertical direction when evacuating the inside of the radiator 1, to a dimension A' between the lower end surface of the legs 11 and the centers of the bolt holes of the fixing sections 14. However, any tolerance is omitted. Specifically, when the motor fan unit 2 is attached to the radiator 1, a clearance of dimension c arises between the upper end surface of the brackets 13 of the radiator 1 and the lower end surface of the legs 11 of the motor fan unit 2 before carrying out evacuation of the radiator.

FIGS. 7A, 7B, 7C, 8A, and 8B show a sequence of operations for inserting the insertion section 12 of the motor fan unit 2 into the bracket 13 when carrying out the attachment operation shown in FIGS. 6*a* and 6B. The operation advances in the sequence shown in FIG. 7A, FIG. 7B, FIG. 7C, FIG. 8A, and FIG. 8B.

Figure 7A:
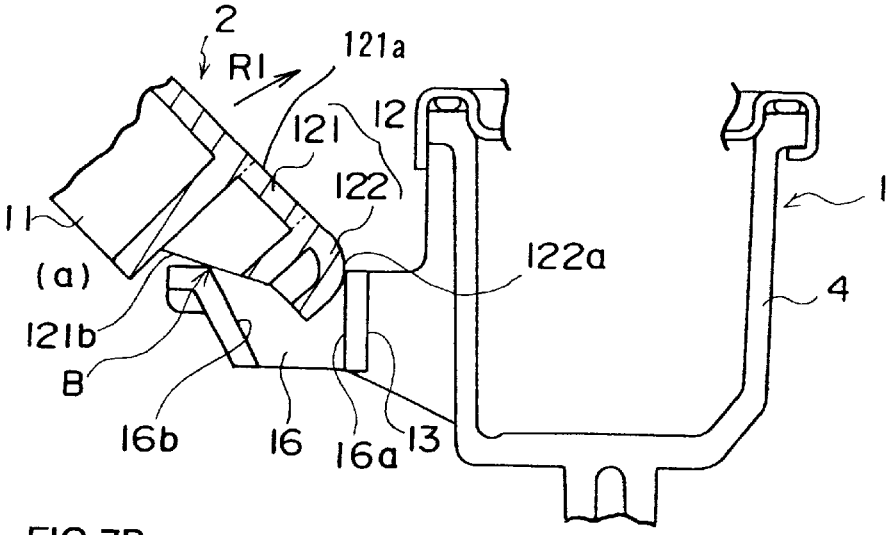
FIG. 7A is a drawing at the time of attachment for describing the aspect of inserting the plug into the bracket.

In FIG. 7A, the motor fan unit 2 is positioned and held at an angle so that the inclined surface 121*b* of the wedge shaped section 121 comes into contact with the upper end B of the inclined surface 16*b* of the bracket 13.

Figure 7B:
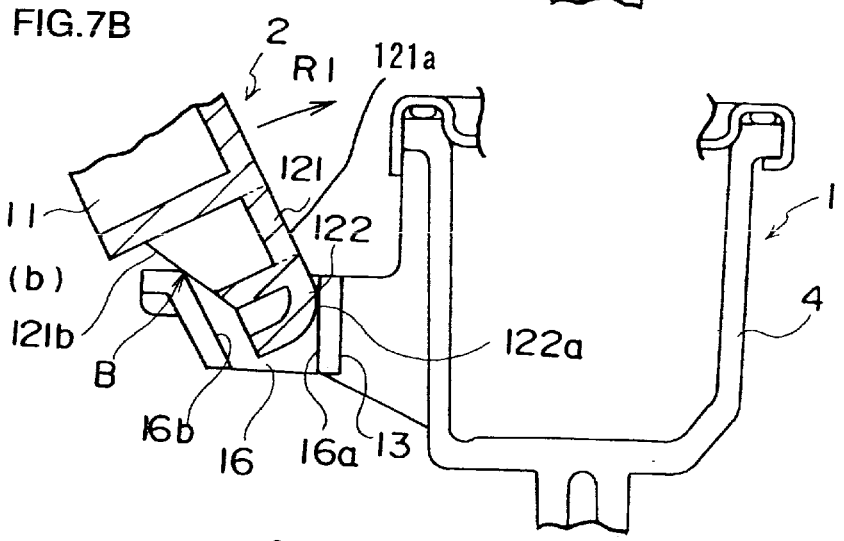
FIG. 7B is a drawing showing the attachment operation continuing on from FIG. 7A.
Figure 7C:
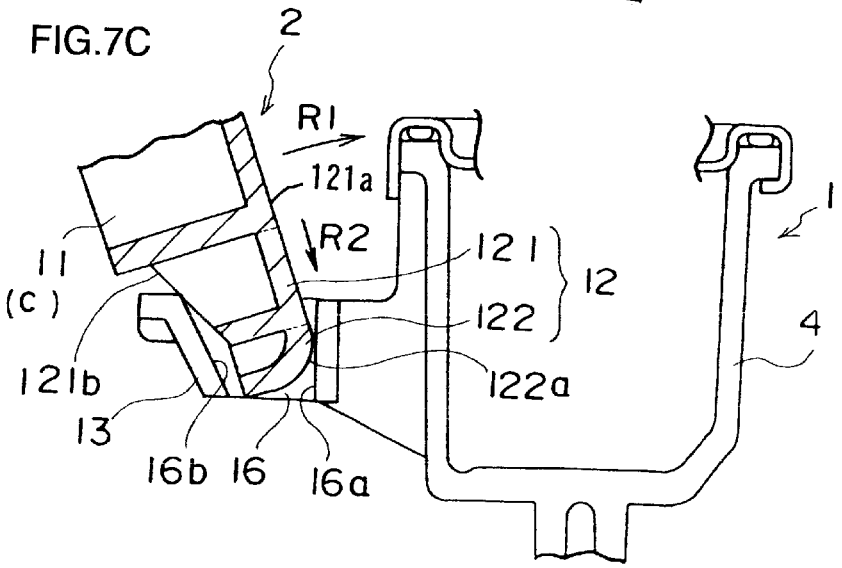
FIG. 7C is a drawing showing the attachment operation continuing on from FIG. 7B.
Figure 8A:
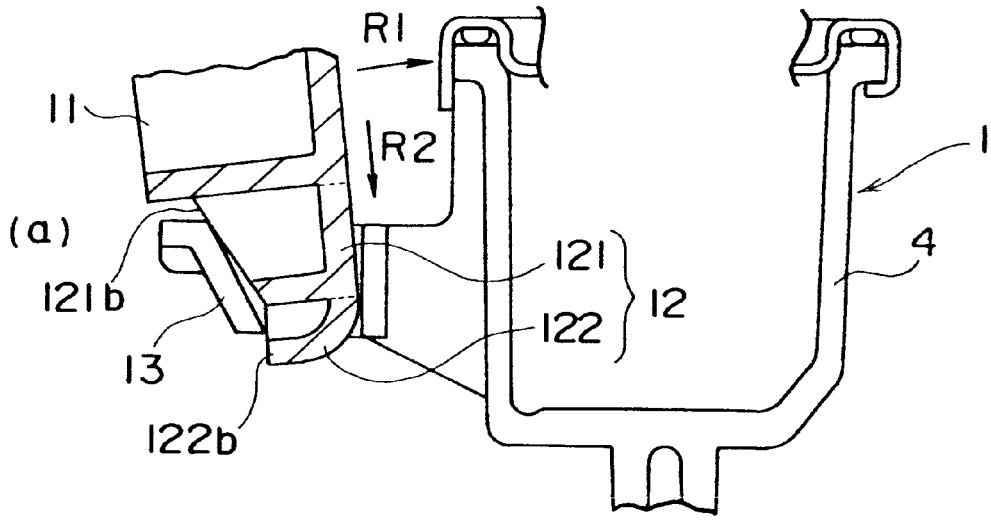
FIG. 8A is a drawing showing the attachment operation continuing on from FIG. 7C.
Figure 8B:
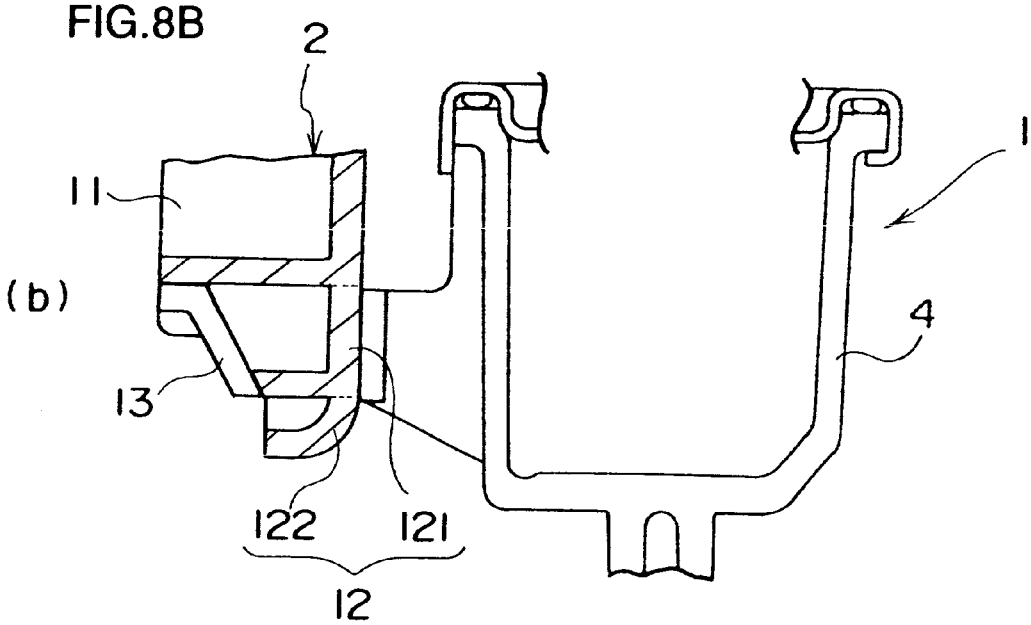
FIG. 8B is a drawing showing the attachment operation continuing on from FIG. 8A.

Next, the motor fan unit 2 is raised towards the radiator 1 with the upper end B as a fulcrum, as shown by the arrow R1. At that time, the R surface 122*a* of the tip section 122 is in contact with the perpendicular surface 16*a* of the bracket 13. From the state of FIG. 7B, when the motor fan unit 2 is raised further towards the radiator 1, then as shown in FIG. 7C and FIG. 8A, the insertion section 12 is inserted so as to slide down inside the hole, namely the inserted section 16 in the bracket 13, as shown by the arrow R2. At this time, the R surface 122*a* of the insertion section 12 moves along the perpendicular surface 16*a* of the bracket 13. Finally, when the motor fan unit 2 is set in a vertical state, the wedge shaped section 121 of the insertion section 12 is completely inserted into the wedge shaped hole 16 (refer to FIG. 4) of the bracket 13, as shown in FIG. 8B.

After that, the fixing sections 14 and the bolt fastening sections 15 constituting the upper attachment sections, are bolt fastened, and attachment of the motor fan unit 2 to the radiator 1 is completed. At this time, the clearance of dimension c arises between the lower end surface of the legs 11 and the upper end surface of the bracket 13, as described above.

Figure 9:
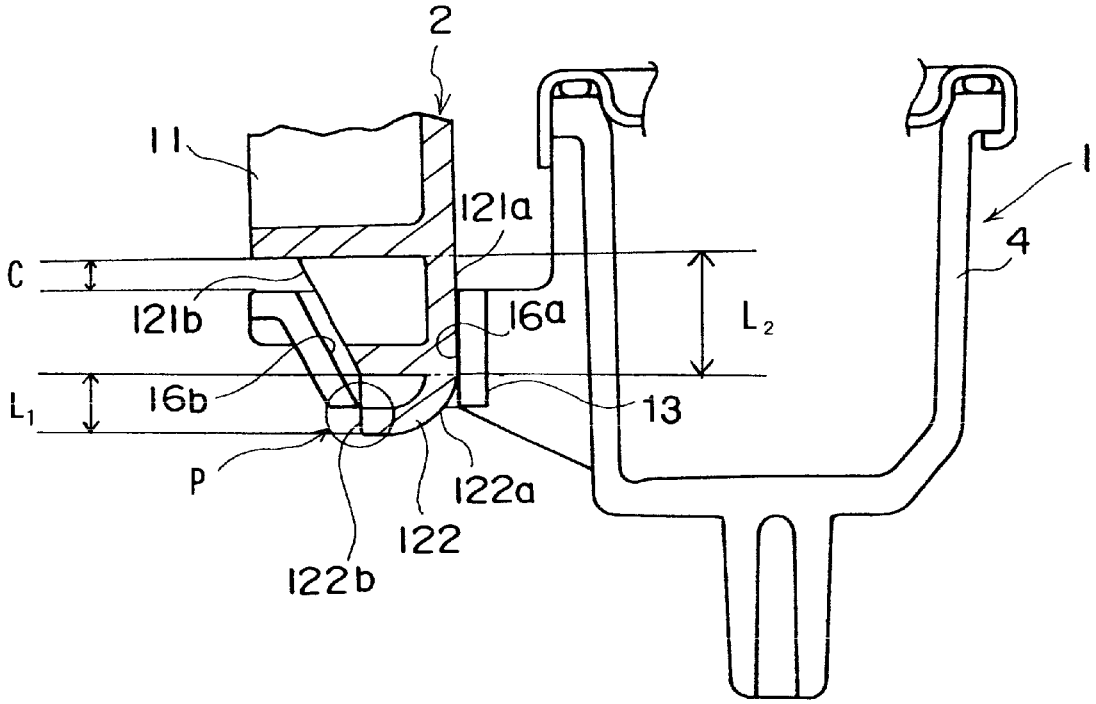
FIG. 9 is a drawing showing the relationship between the plug and the bracket after vacuuming and irrigation of the radiator.

With the motor fan unit 2 attached to the radiator 1, evacuation of the radiator 1 is carried out. This shortens the radiator 1 by the dimension c in the vertical direction, and the insertion section 12 and the bracket 13 are brought into complete contact, as shown in FIG. 6B. After evacuation, if the radiator 1 is irrigated the radiator 1 is stretched in the vertical direction returning to the original dimension A (refer to FIG. 2). In this way, as shown in FIG. 9, a clearance of dimension c arises between the lower end surface of the legs 11 of the motor fan unit 2, and the upper end surface of the bracket 13 of the radiator 1, and also between the inclined surface 121*b* and the inclined surface 16*b*. Earlier technology suffered from the motor fan unit rattling because of this clearance.

However, with this embodiment, even if the radiator 1 is filled with water after evacuation, and the radiator 1 is stretched in the vertical direction, the perpendicular surface 121*a* formed on the wedge-shaped section 121 and the perpendicular surface 16*a* formed on the bracket 13 touch each other, as shown in FIG. 9, and in the section shown by the symbol P the perpendicular surface 122*b* of the tip section 122 and the lower part of the inclined surface 16*b* touch each other. For this reason, there is no rattling of the motor fan unit 2, even if vibration of the radiator 1 increases.

With this embodiment, the motor fan unit 2 is mounted on the radiator 1 in an inclined state, as shown in FIG. 6A, and following that, the motor fan unit 2 is raised with the bracket 13 as a fulcrum and attached to the radiator 1. The operability at the time of attaching the motor fan unit 2 is therefore excellent. By adopting the structure described above, it is possible to make the position of an upper end 10*b* of the fan shroud 10 substantially the same as the upper end of the core 5. In this way, the core 5 of the radiator 1 is almost completely covered by the fan shroud 10, and there is hardly any detrimental effect on the heat radiation performance of the radiator 1.

Figure 10A:
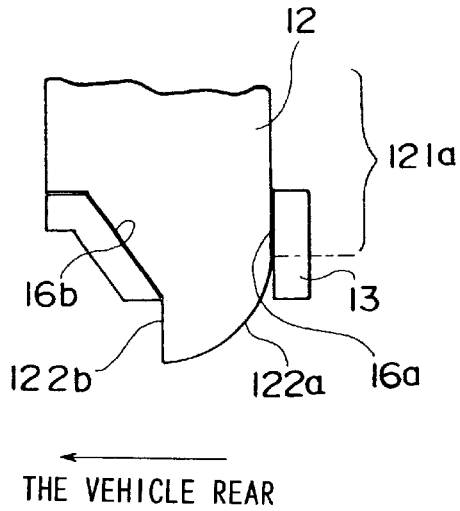
FIG. 10A is a drawing showing a first modified example of a plug.
Figure 10B:
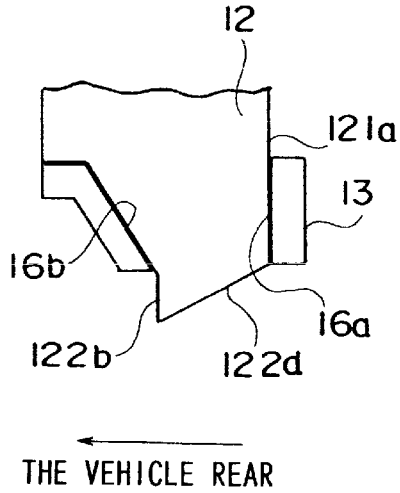
FIG. 10B is a drawing showing a second modified example of a plug.
Figure 10C:
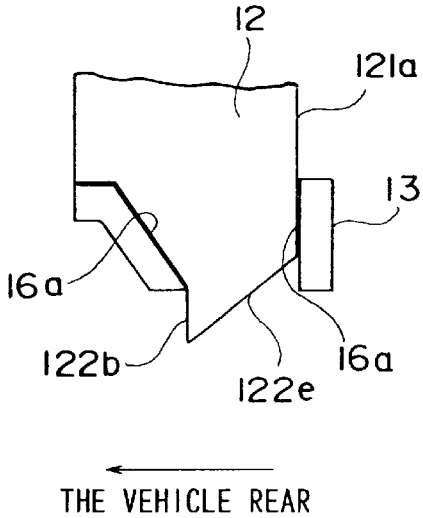
FIG. 10C is a drawing showing a third modified example of a plug.

With this embodiment, the reason that rattling is prevented even if the radiator 1 is stretched in the vertical direction is that the insertion section 12 has both the perpendicular surface 122*b* coming into contact with the lower end of the inclined surface 16*b*, and the perpendicular surface 121*a* coming into contact with the perpendicular surface 16*a*. This means that there is no need for the perpendicular surface 121*a* to make contact from the upper end to the lower end of the perpendicular surface 16*a*. Specifically, even when the radiator 1 is evacuated and irrigated, and the size of the radiator 1 expanded in the vertical direction, the perpendicular surface 122*b* comes into contact with the lower end of the inclined surface 16*b*, and part of the perpendicular surface 121*a* comes into contact with part of the perpendicular surface 16*a*. FIGS. 10A, 10B and 10C show a modified example of the insertion section 12. For example, as shown in FIG. 10A, the radius of curvature of the R surface 122*a* can be made larger. In this case, it is not necessary to provide the flat surface 122*c* of the insertion section 12. Also, as shown in FIGS. 10B and 10C, it is possible to provide flat surfaces 122*d* and 122*e* that sweep back towards the rear of the vehicle closer to the tip of the tip section 122, instead of the R surface 122*a*.

A method of setting the size of the perpendicular surfaces 122*b* and 121*a* in the perpendicular direction will now be described. As shown in FIG. 9, the size in perpendicular direction of the perpendicular surface 122*b* is made L1, and a size of a section contacting the perpendicular surface 121*a* and the perpendicular surface 16*a* when the insertion section 12 is completely inserted in the bracket 13 is made L2. Of L1 and L2, the surface that is shorter relates to rattling arising when the radiator 1 expands. With the shorter of the dimensions L1 and L2 being taken as L, stretching of the radiator 1 due to evacuation and irrigation, that is, the extent c to which the radiator 1 shrinks in the vertical direction due to evacuation, and tolerances for the size A of the radiator 1 and for the size A' of the motor fan unit 2 in the perpendicular direction are respectively a and b. The dimension L is preferably set so as to satisfy the following equation (1).

$$L \geqq a+b+c \quad (1)$$

For example, if a=1.5 mm, b=1.0 mm and c=1.5 mm, then preferably L≧4 (mm) Further, if tolerance for the bolt holes of the motor fan unit 2 is taken into consideration, then preferably L=7 (mm).

For example, if L1<L2, as shown in FIG. 9, then dimension L1 of the shorter perpendicular surface 122*b* in the perpendicular direction is preferably set so as to satisfy equation (1). At this time, if the extent c of stretching of the radiator 1 due to irrigation after evacuation, becomes less than 1.5 mm, then contact between the perpendicular surface 122*b* and the lower section of the inclined surface 16*b* is maintained, and no rattling arises. The shape of the insertion section 12 is not limited to that shown in FIG. 9, and it is possible to also set the dimension L to satisfy the above equation (1) even with the insertion sections 12 shown in FIGS. 10A, 10B and 10C.

Figure 11:
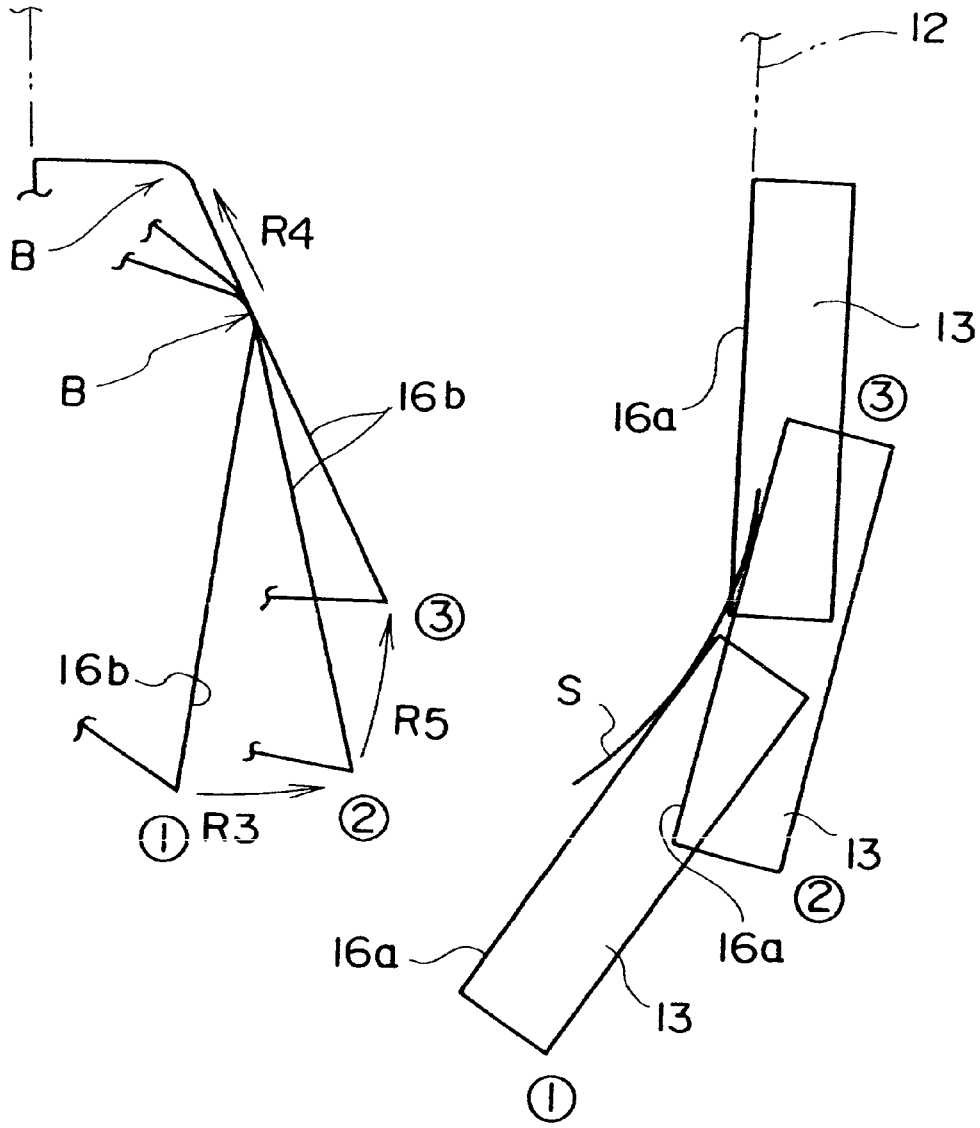
FIG. 11 is a drawing showing insertion of the plug into the bracket, divided into three stages.

A description will be given of setting of the R dimension (radius of curvature) of the R surface 122*a* of the plug 12 referring to FIG. 11. As shown in FIGS. 7A and 7B, when the motor fan unit 2 is raised in the direction of arrow R1, the motor fan unit 2 rotates with the upper end B of the inclined surface 16*b* that is touching the inclined surface 121*b* as a fulcrum. Then, as shown in FIGS. 7C and 8A, the motor fan unit 2 rotates with the upper end B of the inclined surface 16*b* as a fulcrum, and also moves so as to be lowered down in the direction of arrow R2. FIG. 11 is a drawing showing insertion of the insertion section 12 into the bracket 13, divided into three stages.

FIG. 11 shows the bracket 13 moving relative to the insertion section 12. The insertion section 12 is shown by two-dot chain lines. Also, the position of the bracket 13 is shown at three separate stages (①, ②, ③), and the bracket 13 moves in the order ①, ②, ③. It is to be noted that ③ represents the state when the insertion section 12 is fully inserted into the bracket 13.

From position ① to position ②, the bracket 13 rotates in the direction of arrow R3 with the upper end B of the inclined surface 16*b* as a center. Arrow R3 corresponds to arrow R1 described above. From position ② to position ③, the bracket 13 moves in the direction of arrow R5. Movement of the bracket 13 shown by arrow R5 is a composite movement made up of rotational movement in the direction of arrow R3 with the upper end B as a center, and a movement of the upper end B moving in the direction of arrow R4 along the inclined surface 121*b* of the insertion section 12. Arrow R4 corresponds to arrow R2 described above.

The surface 16*a* of the bracket 13 moves along the curved surface S as the bracket 13 moves from position ① to position ③. The curved surface S can be the R surface 122*a* of the insertion section 12. The R surface 122*a* is composed of a curved surface having a span that does not intersect the surface 16*a* of the bracket 13 at position ③.

Figure 12A:
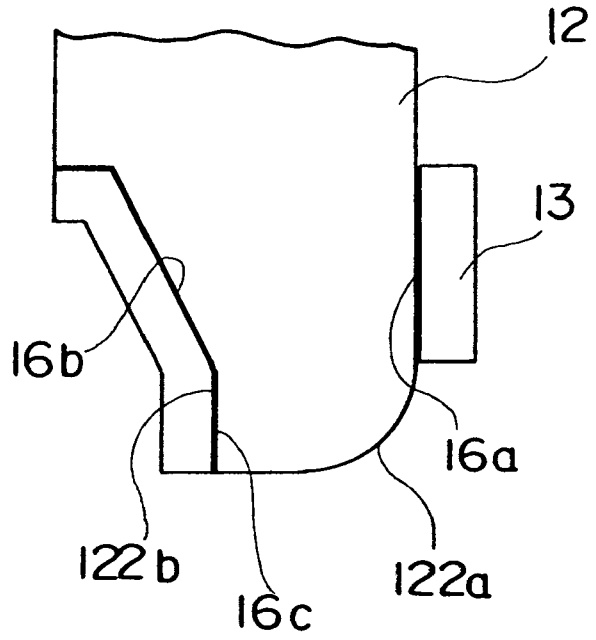
FIG. 12A is a drawing showing a modified example of the bracket.
Figure 12B:
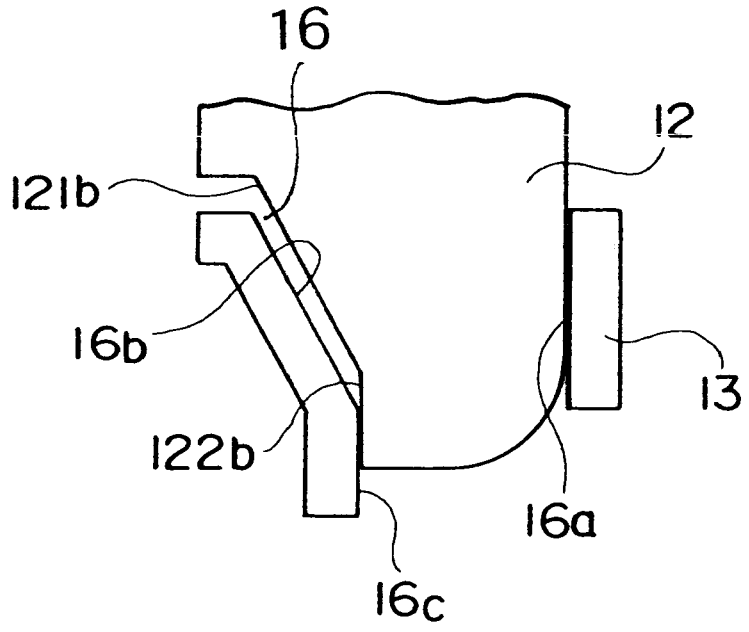
FIG. 12B is a drawing showing a modified example of the bracket

FIGS. 12A and 12B are drawings showing a modified example of this embodiment. As shown in FIGS. 12A and 12B, a surface 16*c* extending in the perpendicular direction, that is, in the downward direction in FIG. 12A, is formed continuous to the lower end of the inclined surface 16*b* of the bracket 13. FIG. 12B shows the positional relationship between the insertion section 12 and the bracket 13 when the radiator 1 has been expanded by irrigation after evacuation. FIG. 12B corresponds to FIG. 9 described above. As shown in FIG. 12B, the inclined surface 121*b* of the plug 12 and the inclined surface 16*b* of the bracket 13 are separated, but the perpendicular surface 122*b* of the insertion section 12 is touching the perpendicular surface 16c of the bracket 13. Therefore, compared to the case described above where the lower end of the inclined surface 16*b* touches the perpendicular surface 122*b*, the effect of preventing rattling is even more pronounced, and it is possible to reduce the effects of abrasion.

The motor fan unit attachment structure of the present invention is not limited to the above-described embodiment, and various modifications are possible.

With the above described embodiment, a through hole 16 has been formed in the bracket 13 as an inserted section into which the plug 12 is to be inserted. However, if there are the perpendicular surface 16*a*, the inclined surface 16*b* and the perpendicular surface 16*c*, it is also possible to have an indentation instead of the through hole. The depth of the indentation in the vertical direction is set to be longer than the vertical length of the plug 12, so that the plug 12 is fully inserted into the indentation when the radiator 1 is evacuated and shrunk.

As has been described above, in the motor fan unit attachment structure according to one embodiment of the present invention, an inclined surface 16*b* and a perpendicular surface 16*a* are provided on a bracket 13 provided on a lower part of a radiator, and a wedge shaped hole 16 or indentation is formed by the inclined surface 16*b* and the perpendicular surface 16*a*. Also, an inclined surface 121*b*, a perpendicular surface 122*b* formed continuous to the inclined surface 121*b* for contacting a lower end of the inclined surface 16*b* of the bracket 13, and a perpendicular surface 121*a* for contacting the perpendicular surface 16*a* of the bracket 13, are provided on the insertion section 12 provided at a lower end of the motor fan unit. These surfaces are provided so that even if the radiator is filled with water after evacuation and the radiator expands in the perpendicular direction, the lower end of the inclined surface 16*b* contacts the perpendicular surface 122*b*, and the perpendicular surface 16*a* and the perpendicular surface 121*a* come into contact with each other. In this way, it is possible to prevent rattling of the motor fan unit in the lengthwise direction of the vehicle.

Furthermore, a perpendicular surface 16*c* extending further down in the perpendicular direction than a lower end of the inclined surface 16*b* of the bracket 13 and coming into contact with the perpendicular surface 122*b* of the insertion section 12 is provided. In this way, in addition to the effects described above, it is possible to prevent rattling in a more stable manner.

The R surface 122*a* is provided on the radiator side tip of the insertion section 12. When the motor fan unit is attached to the radiator, the R surface 122*a* of the insertion section 12 moves along the perpendicular surface 16*a* of the bracket 13. In this way, it is possible to carry out smooth attachment, giving good operability. If the R surface is not curved but flat, it can be manufactured easily.

The disclosure of the following priority application is herein incorporated by reference:

Japanese Patent Application No. 2001-001817 filed Jan. 9, 2001.

What is claimed is:

1. A motor fan unit attachment structure, comprising:

upper attachment sections provided on respective upper parts of a radiator and a motor fan unit attached to said radiator at a downstream side of air flow through said radiator, and fastened together using fastening members; and lower attachment sections that include an inserted section provided on a lower part of said radiator, and an insertion section provided on a lower part of said motor fan unit for inserting into said inserted section; wherein said inserted section is a wedge shaped hole or indentation that narrows towards a lower end of said inserted section, and is provided with an inclined surface formed at a downstream side of air flow through said radiator, and a perpendicular surface formed at a position opposite to said inclined surface; and said insertion section is provided with a first contact section formed so as to extend in a perpendicular direction, that contacts said perpendicular surface, a second contact section that contacts a lower end of said inclined surface and extends by a specified length in the perpendicular direction beyond said lower end of said inclined surface, and a third contact section, formed opposite to said first contact section, capable of contacting said inclined surface of said inserted section.

2. The motor fan unit attachment structure according to claim 1, wherein:

said inserted section is further provided with a second perpendicular surface that contacts said second contact section, extending perpendicularly further down beyond said lower end of said inclined surface.

3. The motor fan unit attachment structure according to claim 1, wherein:

said insertion section is further provided with a sliding surface formed between a lower end of said first contact section and a lower end of said second contact section, so that said insertion section moves along said perpendicular surface of said inserted section when said insertion section is inserted into said inserted section.

4. The motor fan unit attachment structure of claim 3, wherein:

said sliding surface includes a curved surface formed continuous to said first contact section, and curving to a lower side of said insertion section.

5. The motor fan unit attachment structure according to claim 3, wherein:

said sliding surface is a flat surface connecting said first contact section and said second contact section.

6. The motor fan unit attachment structure according to claim 1, wherein:

an angle formed by said inclined surface and said perpendicular surface of said inserted section is substantially equal to an angle formed by said first contact section and said third contact section of said insertion section.

7. A motor fan unit attachment structure, comprising:

upper attachment sections provided on respective upper parts of a radiator and a motor fan unit attached to said radiator at a downstream side of air flow through said radiator, and fastened together using fastening members; and lower attachment sections that includes an inserted section provided on a lower part of said radiator, and insertion section provided on a lower part of said motor fan unit for inserting into said inserted section; wherein said inserted section is a wedge shaped hole or indentation that narrows towards a lower end of said inserted section, and is provided with an inclined surface formed at a downstream side of air flow through said radiator, and a perpendicular surface formed at a position opposite to said inclined surface; and said insertion section is provided with a first contact section formed so as to extend in a perpendicular direction, that contacts said perpendicular surface, a second contact section that contacts a lower end of said inclined surface and extends by a specified length in the perpendicular direction beyond said lower end of said inclined surface, a third contact section formed opposite to said first contact section and enabling contact with said inclined surface, and a sliding surface formed between a lower end of said first contact section and a lower end of said second contact section so that said insertion section moves along said perpendicular surface of said inserted section when said insertion section is inserted into said inserted section.

8. A radiator assembly fitted with a motor fan unit, wherein:

a radiator and a motor fan unit are integrated using a motor fan unit attachment structure of any one of claim 1 to claim 7.

* * * * *